US006434993B1

(12) United States Patent
Broggi et al.

(10) Patent No.: US 6,434,993 B1
(45) Date of Patent: Aug. 20, 2002

(54) BENDING MACHINE FOR BENDING THREADLIKE MATERIAL SUCH AS TUBES, RODS PROFILES OR METAL WIRE

(75) Inventors: Mauro Broggi, Cucciago; MarioAlberto Biella, Seregno, both of (IT)

(73) Assignee: BLM S.p.A., Cantu (IT)

( * ) Notice: Subject to any disclaimer, the term of this patent is extended or adjusted under 35 U.S.C. 154(b) by 0 days.

(21) Appl. No.: 09/780,546

(22) Filed: Feb. 8, 2001

(51) Int. Cl.[7] ..... B21D 7/04
(52) U.S. Cl. ..... 72/157; 72/306
(58) Field of Search ..... 72/157, 149, 306, 72/307, 217, 387

(56) References Cited

U.S. PATENT DOCUMENTS 4,843,859 A * 7/1989 Togoshi ..... 72/149
5,927,126 A * 7/1999 Biella ..... 72/149

FOREIGN PATENT DOCUMENTS

JP 57-193236 * 11/1982 ..... 72/157
JP 57-193237 * 11/1982 ..... 72/157
JP 61-259835 * 11/1986 ..... 72/157
JP 2001-58215 * 6/2001

* cited by examiner

*Primary Examiner*—Daniel C. Crane
(74) *Attorney, Agent, or Firm*—Kirschstein, etal.

(57) ABSTRACT

A machine for bending threadlike material such as tubes, rods, profiles or metal wire comprises a machine bed, having parallel guides movably supporting a carriage for feeding, rotating and angularly locating the tube, the machine bed having a T-shape, the cross member of the T-shape body being provided, at the top and bottom thereof, with parallel guides supporting a controllably driven movable carriage having a bending head provided with a fixed shaft supporting, at the two end portions thereof, bending dies with corresponding swinging bending arms, the bending head being supported by a horizontal shaft and being adapted to be controllably driven about the axis of the horizontal shaft.

8 Claims, 5 Drawing Sheets

BENDING MACHINE FOR BENDING THREADLIKE MATERIAL SUCH AS TUBES, RODS PROFILES OR METAL WIRE

BACKGROUND OF THE INVENTION

The present invention relates to a machine for bending threadlike material such as tubes, rods, profiles or metal wire.

As is known in the prior art, for bending tubes, rods, profiles or metal wire bending machines comprising a machine bed, to which the tube the front end portion thereof must be bent is fed are conventionally used. For controllably feeding the tube, a movable carriage which can be controllably driven along parallel guides of the machine bed, the carriage being provided with a gripper assembly for locking the tube, said gripping assembly allowing moreover said tube to be controllably rotated about its longitudinal axis is used.

At the front end portion of this prior tube bending machine a plurality of overlapping bending dies which can be arranged, at will, at said tube to be bent, thereby allowing a known swinging bending arm to perform, at the front end portion of said tubes, bending operations with different bending radii and shapes are moreover provided.

Modern bending machines frequently comprise, at their front side, means for cutting away that portion of the tube which has been bent.

Moreover, prior bending machines also comprises robot controlled gripping members, chutes or conveyor belts, for moving away the bent piece.

In prior bending machines, the shaft supporting the plurality of bending dies, having different bending radii, can be driven in the direction of its longitudinal axis, to bring a selected bending die to a working position thereof, i.e. to cause said bending die to coincide with the axis of the tube to be bent.

The drive for performing the above mentioned translating movement is constructionally complex, and requires control and driving members and a die supporting shaft precisely located with respect to the tube to be bent.

Moreover, the prior bending head is designed to fit two or, at a maximum, three different bending dies, whereas a user of the bending machine would desire to have a larger number of bending dies to immediately use then without stopping the machine, thereby performing a higher number of different radius bending operations.

A further drawback of the prior bending heads is the difficulty of delicately unloading and precisely locating the pieces at the end of their bending without damaging them.

SUMMARY OF THE INVENTION

Accordingly, the object of the present invention is to provide a tube bending machine, including a plurality of different bending dies which can be very quickly and accurately arranged at their working positions, and the bending head of which is so designed as to allow the machined pieces to be delicately and accurately unloaded.

According to the present invention, the above object is achieved by a machine for bending tubes, rods, profiles or metal wire, comprising a machine bed having parallel guides movably supporting a carriage for feeding, rotating and locking at a set position said tube, characterized in that the machine bed has a T-shape body, that a cross-member of the T-shape body has parallel guides supporting a controllably driven movable carriage, that said carriage has a bending head, provided with a fixed shaft supporting at the end portions thereof bending dies including corresponding swinging bending arms and that said bending head is supported by a horizontal shaft and can be controllably driven about the axis of the horizontal shaft.

In a machine having the above mentioned characteristics, it would be possible to quickly and accurately locate a bending die, selected for performing a bending operation, with respect to a tube to be bent.

For replacing the bending die it is not necessary to switch off the bending machine and, moreover, it is possible to very accurately unload the tube after having bent it, by suitably inclinating the bending head.

Moreover, the subject machine advantageously allows to perform any desired bending operations, either in a rightward or in a leftward direction. The bent piece can be unloaded either rightward or, at will, leftward with respect to the machine bed.

BRIEF DESCRIPTION OF THE DRAWINGS

The subject matter of the present invention will be disclosed in a more detailed manner hereinafter with reference to an exemplary embodiment thereof which is illustrated in the accompanying drawings, where.

DESCRIPTION OF THE PREFERRED EMBODIMENTS

Figure 1:
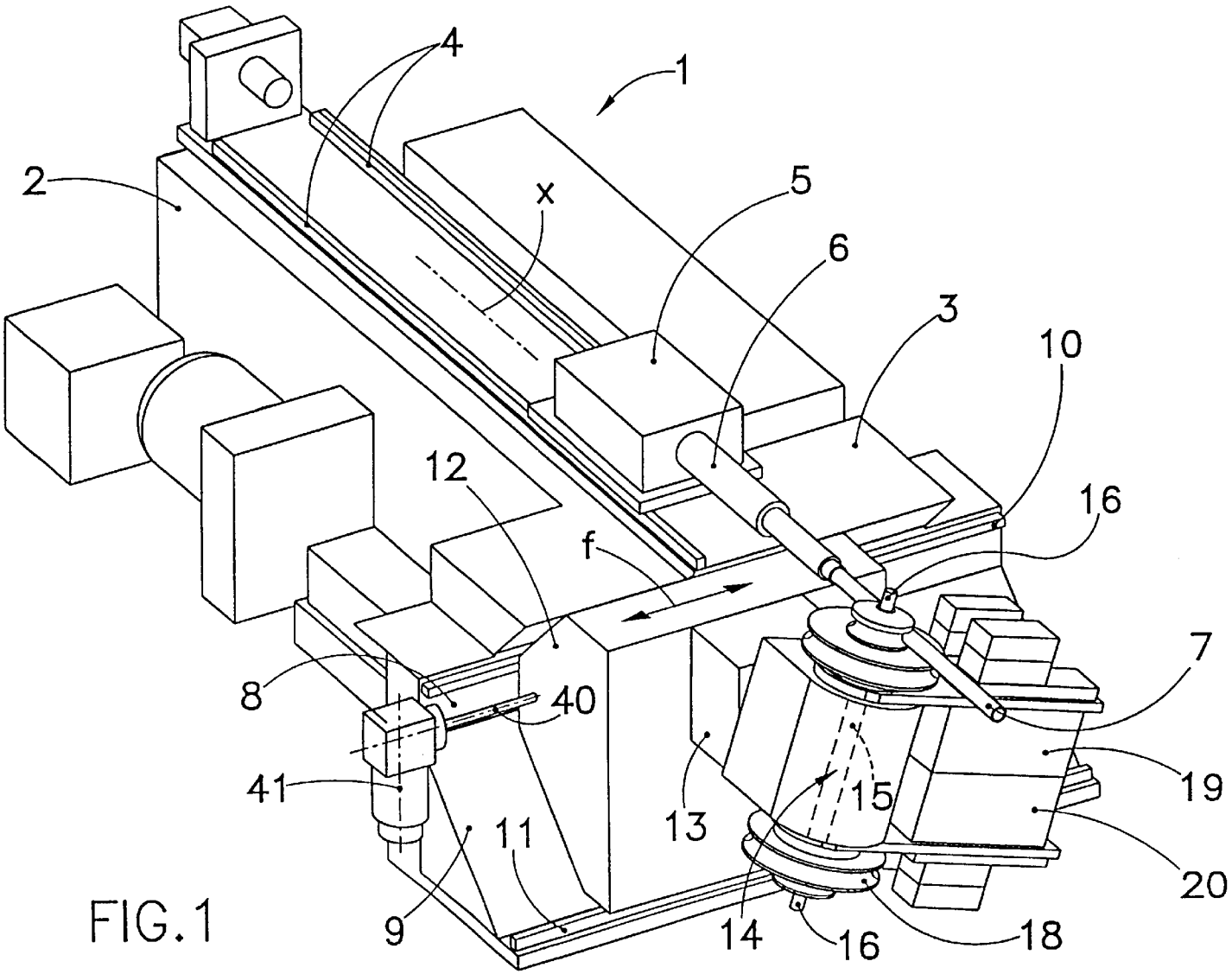
FIG. 1 is a perspective view of the bending machine.

As shown in FIG. 1, the bending machine, generally indicated by 1, is provided with a T-shape machine bed, including a longitudinal portion 2 and a cross-member 3 forming the front end portion of the machine 1.

At the top thereof the machine bed 2, 3 is provided with precision parallel guides 4 on which is movably supported a known carriage 5, including a gripper 6 for locking a tube 7 and allowing the tube 7 to be rotated about its longitudinal axis, schematically indicated by X.

The cross-member 3 is provided, on the front side thereof, with a vertical wall portion 8 meeting with an inclined frontward extending wall portion 9, the wall portion supporting a precision guide 10 and, at the end of the inclined wall 9 a further precision guide 11 being provided.

In the recess defined by said walls 8 and 9 a prismatic-shape carriage 12 is arranged.

At the top thereof, the carriage 12 abuts on said precision guide 10 whereas, at the bottom thereof, said carriage 12 abuts on said precision guide 11.

By a ball recirculating screw 40 and a controllable motor 41, for example, said carriage 12 can be driven in the direction indicated by the double arrow f to be located with a very great precision with respect to the tube 7 to be bent.

At the front thereof the carriage 12 is rigid with a supporting body 13 receiving, for example through a horizontal shaft 42 supported by strong precision bearings fitted inside said body 13, a bending head, generally indicated by 14.

Figure 5:
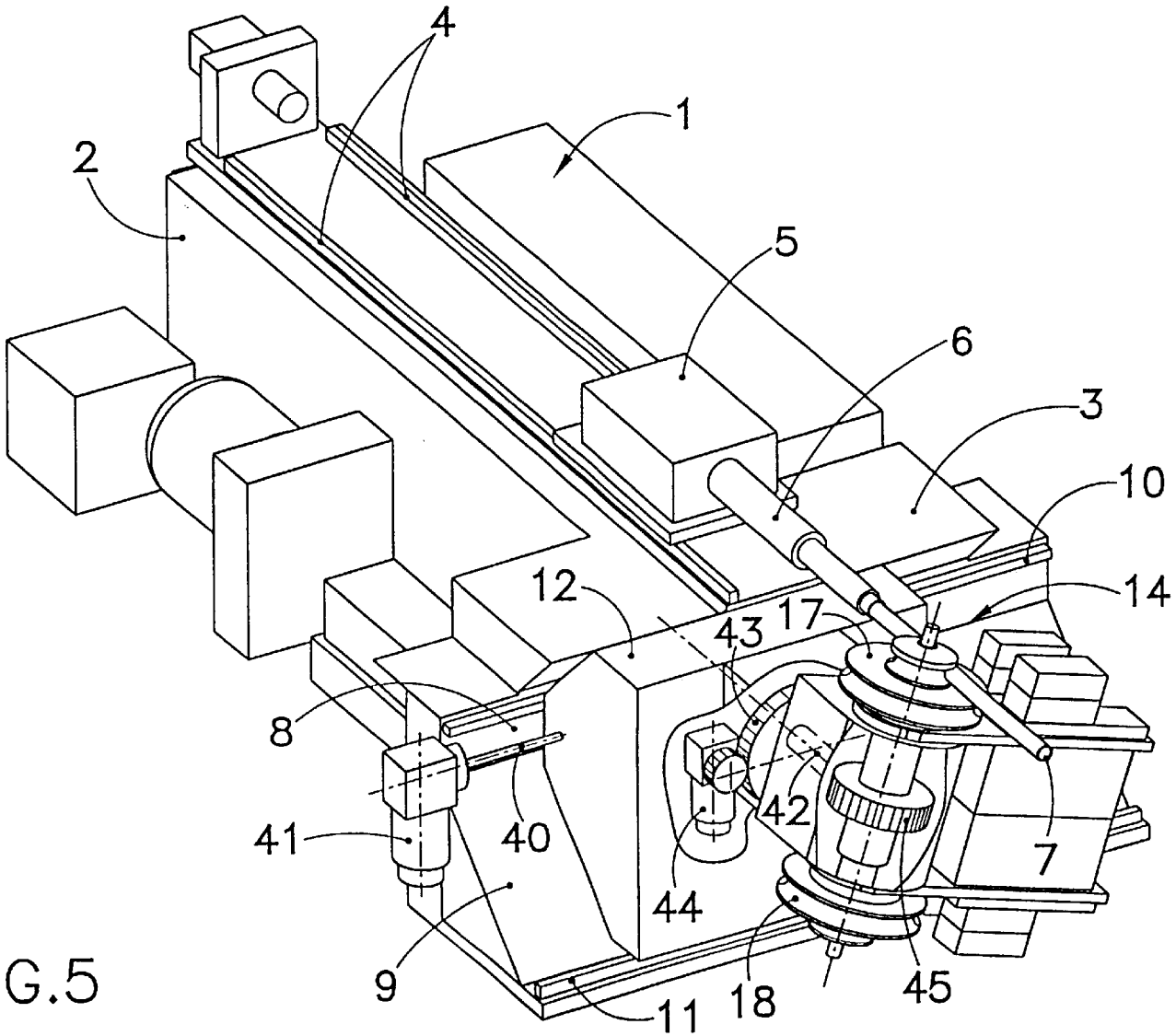
FIG. 5 is a perspective view of the bending machine which also schematically illustrates the several driving motors thereof.

The horizontal shaft 42 is rigid with a gear ring 43, fitted in said supporting body 13, and driven by a controllable motor 44, fitted in said carriage 12 (see FIG. 5).

The bending head 14 has a supporting shaft 15 which is locally fixed with respect to the body of the head 14, the projecting end portions 16 of the shaft 15 supporting die assemblies 17, 18, the dies of which have different bending diameters.

To each die assembly 17, respectively 18, a known swinging bending arm, indicated by 19, respectively 20, is coupled.

The bending arms 19, 20 are swingably supported about the axis of the shaft 15, which, to that end, supports a rotary gear ring 45, which is in turn so supported as to perform, by a controlled motor, a swinging movement for the bending assemblies 19, 20.

Figure 2:
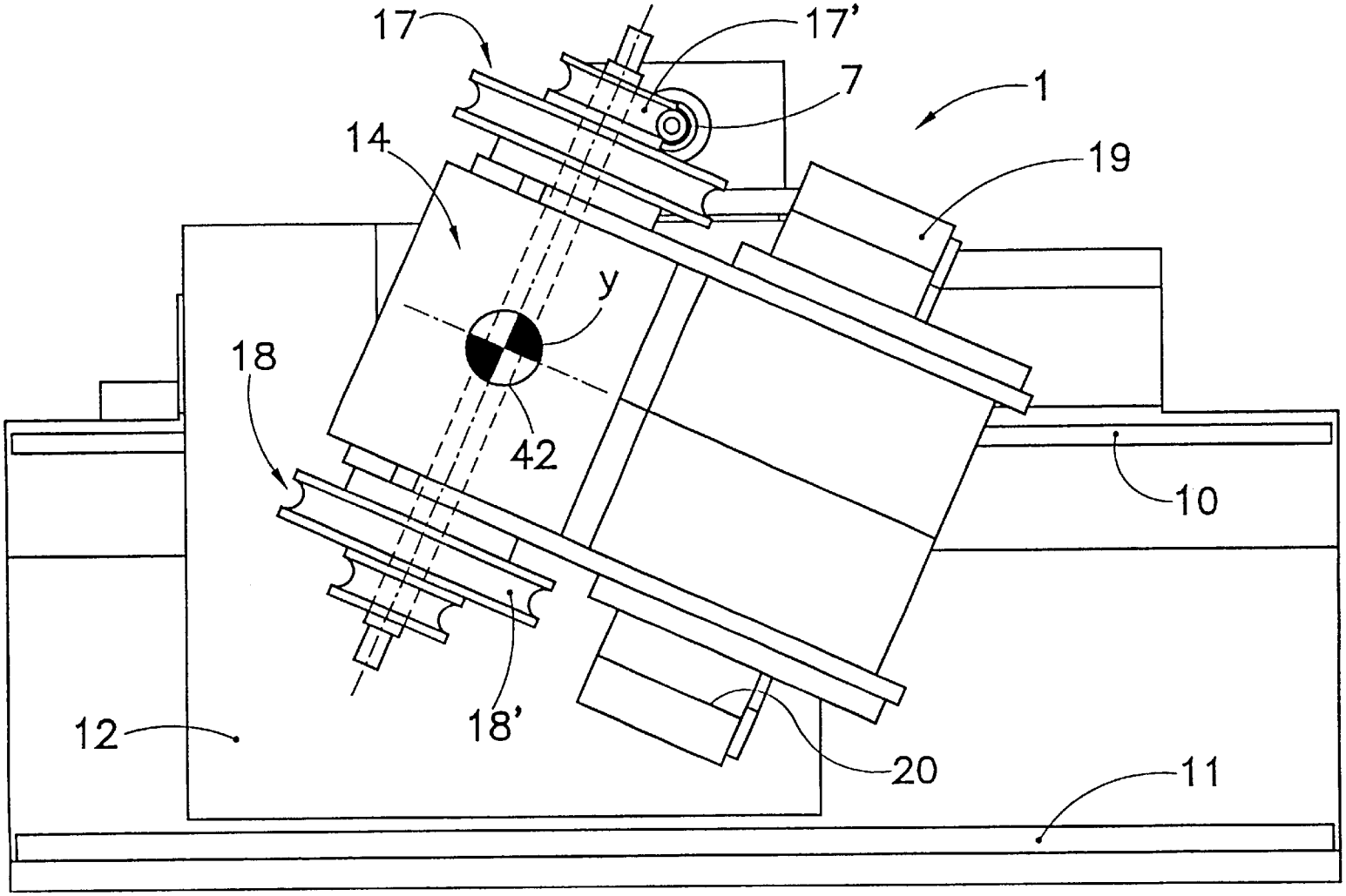
FIG. 2 is a front view of the bending machine, with the bending head at a first bending position.

FIG. 2 is a front view of the subject bending machine 1.

The carriage 12 is leftward driven on the precision guides 10 and 11, while swinging the bending head 14 about the axis (Y) of the head 14 shaft 42, thereby the top die 17' of the die assembly 17 is so arranged with respect to the tube 7 as to cause the swinging arm unit 19 to perform a bending operation.

Since the bending arm unit 19 is well known to one skilled in the art, it has been only schematically illustrated.

Figure 3:
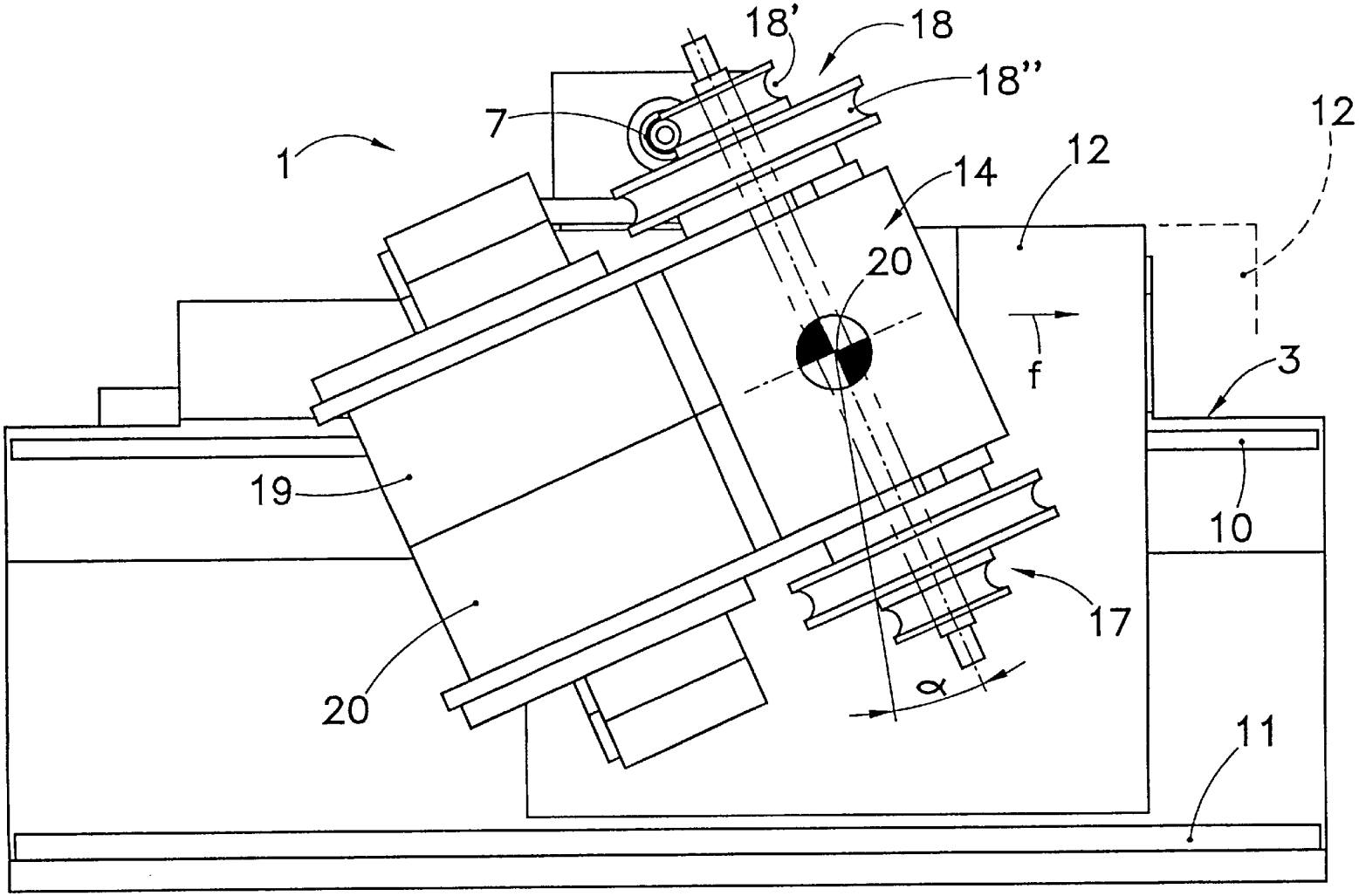
FIG. 3 is a further front view of the bending machine, the bending head being arranged at a second bending position.

FIG. 3 shows that the carriage 12 has been driven on the precision guides 10 and 11 toward the right zone of the cross member 3, while simultaneously swinging the bending head 14 about the axis (Y) to downward displace the bending assembly 17, locate the bending assembly 18 at the top and cause the die 18' to perform its bending operation on the tube 7.

If, for example, the die 18" is to be brought into coincidece with the tube 7, then the carriage 12 must be further driven rightward, as schematically indicated by the arrow (f) while simultaneously swinging the bending head 14 (through a preset angle ($\alpha$)) about the axis (Y) of said head 14, to bring the greater diameter die 18" to its tube bending position.

Then, for properly locating a preset die of the die assembly 17, respectively 18, it is necessary to perform:

a) a precise locating of the carriage 12 on the parallel guides 10, 11;

b) a full rotating, respectively a partial swinging and locatogn of the bending head 14 about the axis (Y) thereof, to bring the circumferential groove of a selected die into coincidence with the tube to be bent.

Figure 4:
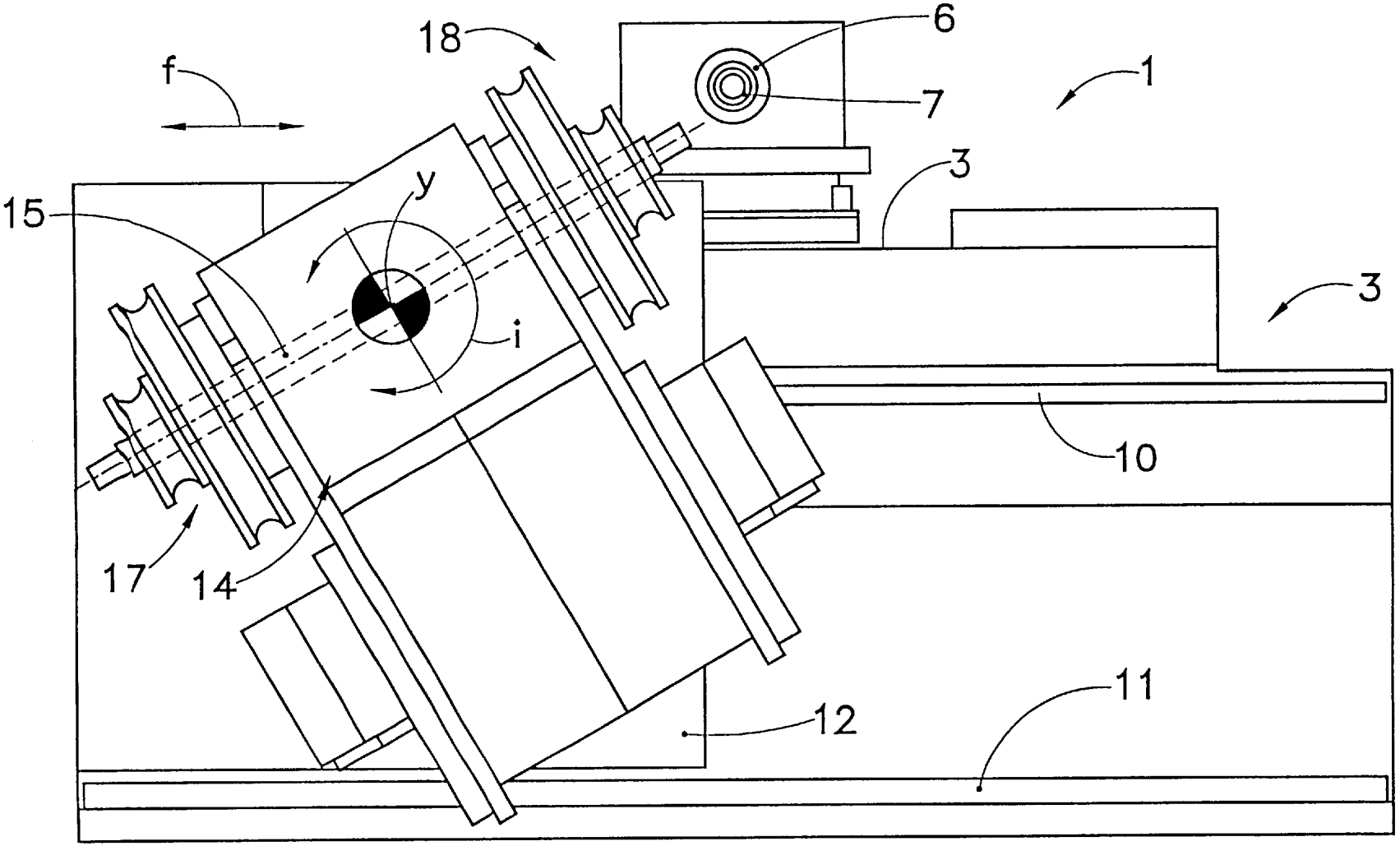
FIG. 4 shows the bending machine as the bending head thereof is rotatively driven.

FIG. 4 shows the locking gripper 6 and the tube 7 to be bent, as well as the parallel guides 10 and 11 arranged on the front side of the cross portion 3 of the machine, generally indicated by 1.

Said carriage 12 can be driven on said parallel guides 10 and 11 in the directions indicated by the double arrow f, whereas the overall bending assembly, indicated by 14, can perform a rotary movement, respectively a swinging movement about the axis (Y) as shown by the double arrow (i).

By superimposing the translation movement (f) of the carriage 12 on the rotary movement (i) it would be possible to quickly bring the die assemblies 18, respectively 17, to the desired working position, by quickly and precisely locating the selected die with respect to the tube 7 to be bent.

Thus, since the bending assembly 14 can be driven together with the dies 17, 18 away from the center of the tube 7, and since the bending assemblies 17, 18 can controllably swing, it would be easily possible to unload the piece without hindering this operation.

Moreover, since the dies 17, 18 can be driven away from the mandrel 6 while allowing said dies to be controllably turned through 360° both rightward and leftward about the axis (Y) of the bending head 14, it would be unexpectedly possible to delicately feed the bent piece for example to a conveyor belt or chute (not shown).

FIG. 5 shows that the carriage 12 is operatively coupled to a ball recirculating screw 40, driven by a controllable motor 41 controllably bending machine numeric controller.

To rotatively drive the bending assembly 14, the horizontal shaft 42 is provided with a gear ring 43, engaging with a pinion of a motor 44 which can also be controlled by the numeric controller of the bending machine 1, thereby the assembly 14 can be inclined through a preset angle or rotated through 360°.

To swing the bending arms 19, 20, a rotary gear ring 45 operatively coupled to the swinging arms is arranged on said shaft and coupled to a pinion (not shown) driven by a controllable motor (not shown in FIG. 5) and operatively coupled to the numeric controller of the machine 1.

What is claimed is:

1. A machine for bending an elongated workpiece, comprising:

a) a bed having a body portion extending along a longitudinal axis, and a head portion extending along a transverse axis perpendicular to the longitudinal axis;

b) a pair of longitudinal guides on the body portion in parallelism with the longitudinal axis;

c) a pair of transverse guides on the head portion in parallelism with the transverse axis;

d) a body carriage for holding the workpiece and mounted on the longitudinal guides for movement along the longitudinal axis;

e) a head carriage mounted on the transverse guides for movement along the transverse axis;

f) a workpiece bending assembly mounted on the head carriage for joint movement therewith along the transverse axis, the assembly including an elongated shaft, a pair of bending dies at opposite end regions of the shaft, and a pair of bending arms each operative for bending the workpiece against a respective bending die; and g) a drive for turning the bending assembly about a turning axis parallel to the longitudinal axis to position a selected one of the bending dies against the workpiece to be bent, the turning drive being mounted on the head carriage so that the turning drive can be moved along the transverse axis with the head carriage.

2. The machine of claim 1, wherein the dies have different bending diameters.

3. The machine of claim 1, wherein each end region has two bending dies of different bending diameters.

4. The machine of claim 1, wherein each bending arm is mounted for angular movement on the shaft.

5. The machine of claim 1, wherein the drive includes a drive shaft extending along the turning axis, and a motor for turning the drive shaft and the bending assembly.

6. The machine of claim 5, wherein the motor has a pinion gear, and wherein the drive shaft is connected to an annular gear in meshing engagement with the pinion gear.

7. The machine of claim 1, and comprising means for moving the head carriage, including a control motor and a threaded rod on which the head carriage is mounted.

8. The machine of claim 1, wherein the head portion has a generally planar, vertical wall on which one of the transverse guides is mounted, and a forwardly inclined wall on which the other of the transverse guides is mounted.

US 6,434,993 B1
5 6

* * * * *